US006615896B1

(12) United States Patent
Andalia

(10) Patent No.: US 6,615,896 B1
(45) Date of Patent: Sep. 9, 2003

(54) STORM SHUTTER SYSTEM

(76) Inventor: Roger R. Andalia, 21450 SW. 98th Ct., Miami, FL (US) 33189

( * ) Notice: Subject to any disclaimer, the term of this patent is extended or adjusted under 35 U.S.C. 154(b) by 0 days.

(21) Appl. No.: 10/139,122

(22) Filed: May 3, 2002

(51) Int. Cl.[7] ..... E05D 15/26
(52) U.S. Cl. ..... 160/183; 160/207
(58) Field of Search ..... 160/183, 206, 160/207, 233, 213, 35, 32, 235

(56) References Cited

U.S. PATENT DOCUMENTS 3,670,797 A * 6/1972 Sassano ..... 160/183
5,097,883 A * 3/1992 Robinson et al. ..... 160/183
5,458,179 A * 10/1995 Magaldi et al. ..... 160/183
5,469,905 A 11/1995 McKinney et al. ..... 160/35
5,549,148 A 8/1996 Figueiredo et al. ..... 160/183
5,601,130 A * 2/1997 Werner et al. ..... 160/183
5,740,850 A * 4/1998 Hoffman ..... 160/183
5,957,185 A * 9/1999 Robinson et al. ..... 160/183
6,021,839 A 2/2000 Knezevich et al. ..... 160/183
6,085,822 A * 7/2000 Miller ..... 160/183 X
6,122,868 A * 9/2000 Knezevich ..... 160/183 X
6,148,895 A * 11/2000 Biggers ..... 160/183

* cited by examiner

*Primary Examiner*—David Purol
(74) *Attorney, Agent, or Firm*—J. Sanchelima; A. Bordas

(57) ABSTRACT

A storm shutter assembly for building openings where the several articulated contiguous blade assemblies are housed within a frame assembly and selectively moved between two extreme positions from approximately 4 degrees to 180 degrees. The frame includes a coextensive support surface. The contiguous blade assemblies are hingedly connected at their longitudinal complementary ends. One of the ends includes a longitudinal outer socket fold with two arched arms that journal a longitudinal inner fold at the other end of a contiguous blade assembly. One of the arms is smaller and is arched with a cooperative radius of curvature to receive the longitudinal inner fold. A stopper bay catches one of the arms when the contiguous blade assemblies extend out to a coplanar disposition. Reinforcement longitudinal folds are provided on the blade assemblies that coact with the support surface for transmitting the wind load to the frame assembly directly.

4 Claims, 10 Drawing Sheets

STORM SHUTTER SYSTEM

BACKGROUND OF THE INVENTION

1. Field of the Invention

The present invention relates to a storm shutter system for building openings, and more particularly, to such shutter systems of the accordion type that includes articulated shutter blade assemblies.

2. Description of the Related Art

Many designs for accordion storm shutter systems have been designed in the past that include articulated shutter blade assemblies to protect openings in buildings. These panel members are joined by hinge assemblies (and particularly including hinge pins) that receive and transmit most, if not all, the wind forces to the frame. These hinge assemblies are exposed to considerable shearing strain becoming the most vulnerable components of the systems.

Most of these systems are manufactured with extruded blade panels to reduce cost. This relatively inexpensive manufacturing process, however, injects some design limitations. Also, the blade panels require reinforcement to keep their thickness at a minimum with the consequent cost savings. These reinforcements are typically longitudinal folds since a completely flat panel is more susceptible to high winds for a constant thickness. Thus, the desirability of using in the prior art articulated hinge connections that permit the blade panels to open no more than 90 degrees for flat blade panels to form these folds. The present invention, however, introduces articulated non-flat blades with longitudinal fold reinforcements that open to 180 degrees. The folds are extruded with complementary shapes.

One of these systems is disclosed in U.S. Pat. No. 5,549,148 issued to Figueiredo, et al. in 1996 for a blade for accordion storm shutters. An articulated hinge connection is shown in FIGS. 10 and 11 of that patent. Figueiredo's patented invention provides for hingedly mounted longitudinal blades forming an approximately 90-degree angle with respect to one another in one (closed shutter) configuration and substantially parallel to each other in the other (open shutter) configuration. The hinge assembly includes a socket and a knuckle with a journaled longitudinal pin. The socket includes two protruding internal ribs (inwardly) defining a shoulder that limits the movement of the knuckle to a 90 degrees angle. As shown in FIG. 2, the maximum angle that can be achieved by the longitudinal blades is approximately 90 degrees. The articulated assembly of the present invention, on the other hand, has two complementary fingers that act as stopper members and they are disposed outside the main socket making possible the movement to extend to an approximately 180 degree angle. This permits a user to use extruded blades that are formed with longitudinal bends or folds obviating the need to form these bends or folds with vulnerable hinge assemblies.

Applicant also believes that another related reference corresponds to U.S. Pat. No. 6,021,839 issued to Knezevich, et al. in 2000 for an accordion shutter system with improved header and sill configuration. Knezevich 's patented invention provides support to the shutter blade while reducing load upon the guide pin. However, it differs from the present invention because Knezevich's shutter system is a continuously extruded accordion blade with a male end and a female end that allows the shutter to interlock forming a hinge junction. The disposition of the blades in Knezevich's shutter system limits the movement of the blades to a maximum angle of approximately 90 degrees. The articulated assembly of the present invention allows the disposition of the blades in a range having a minimum of approximately 4 degrees (in shutter open position) to 180 degrees (in shutter closed position).

Finally, Applicant believes that another related reference corresponds to U.S. Pat. No. 5,469,905 issued to McKinney, et al. in 1995 for a security and hurricane shutter. McKinney's patented security and hurricane shutter is for horizontally disposed blades that are pivotally mounted in-between. However, it differs from the present invention because, although the distance between the inner and outer pivots can be varied, it is evident that the largest angle to be adjusted must keep the accordion-like structure shape (90 degrees) in order to keep the strength of the shutter system. The present invention not only has blades with longitudinal reinforcement folds for transmitting the bulk of the wind load to the frame, but all the pin members are kept inside (protected) the frame assembly for better structural stability under high winds load.

One of the common problems found in the prior art is that impact forces strain the hinge pins. Thus, regardless of the type of installation (horizontal or vertical structures) the hinge pin member is the weakest point of most of the accordion like shutter structures. Pins are typically exposed to considerable shearing strain making them the most vulnerable components of shutter system. In the present invention, the frame assembly is mounted outside the closures for building's openings, such as doors or windows. The ends of the longitudinal folds of the blades rest against the longitudinal stoppers mounted on the frame assembly. Therefore, the force exerted by heavy winds or any other impact received by the panel members is transmitted to the ends of the flat portions of the longitudinal folds and then to the wall through the frame assembly thereby relieving the hinge assembly from most of the stress. The compression force transmitted through the hinge assembly is not as damaging as the shearing strain exposure in conventional shutter systems.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a storm shutter system that allows the disposition of reinforced longitudinal folds in articulated blade assemblies movable from a substantially parallel configuration to a fully expanded (180 degrees) configuration.

It is another object of this invention to provide a shutter system that reduces the stress applied to the hinge assemblies of the system by transmitting the load forces to the frame assembly (and wall) through a co-acting flat portion at the lateral ends of the longitudinal fold of the panel member.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
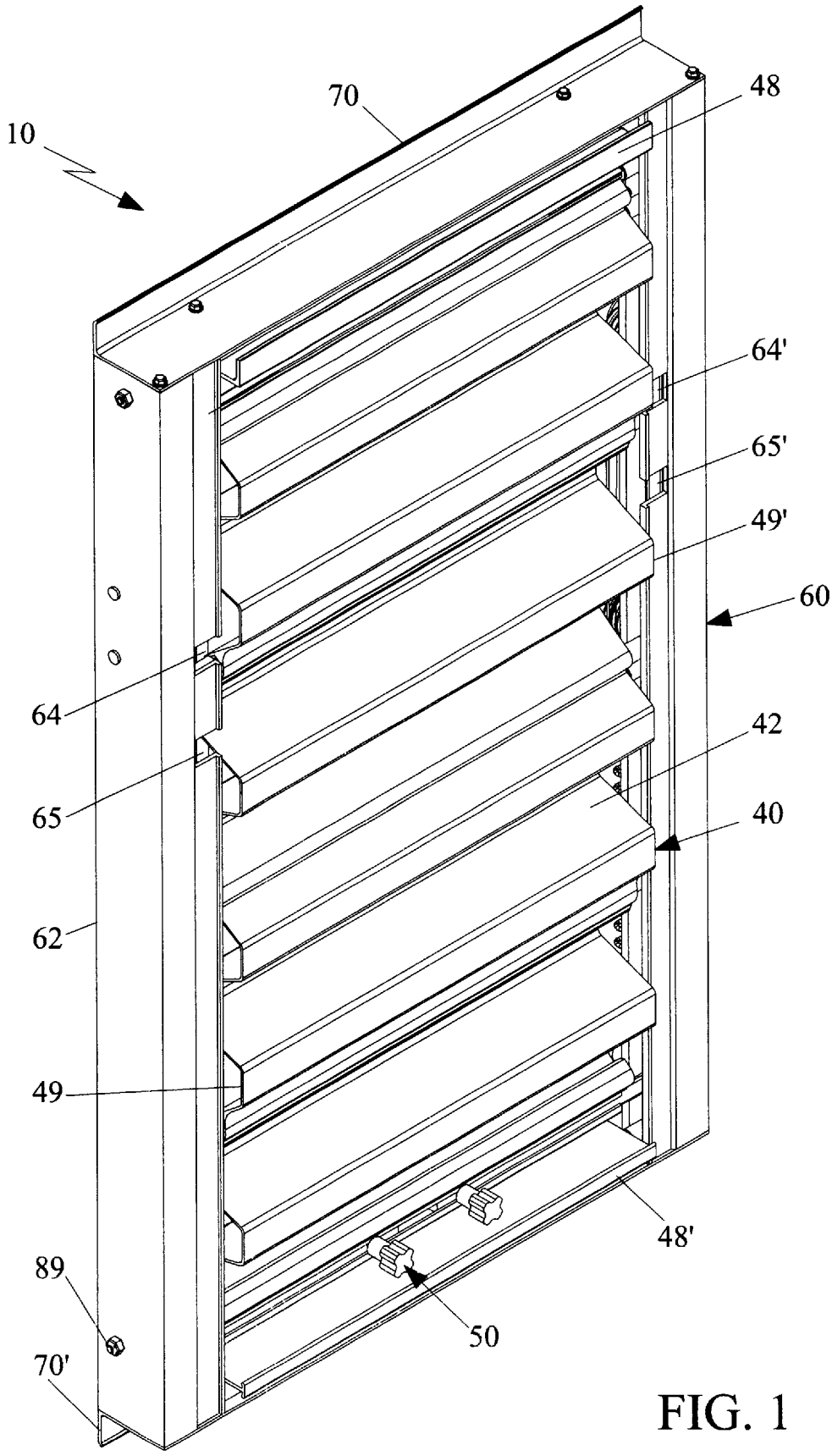
FIG. 1 is an isometric view of one of the preferred embodiments for the storm shutter system, object of the present application, in the closed configuration (protected opening closed).

Referring now to the drawings, where the present invention is generally referred to with numeral 10, it can be observed that it basically includes hinge assembly 20; articulated blade assemblies 40, locking assembly 50, frame assembly 60 and pulley assemblies 80 and 80'.

Figure 2:
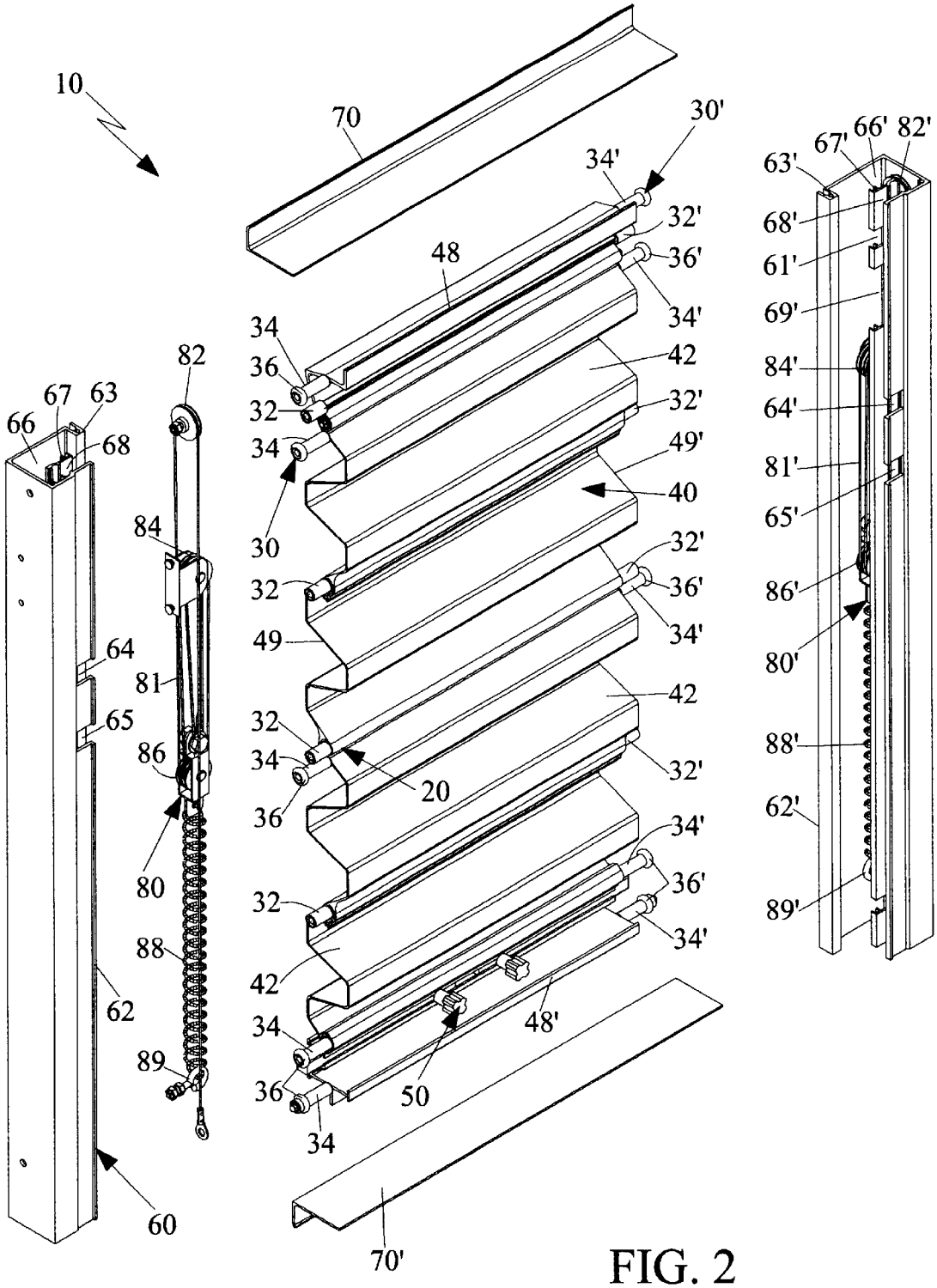
FIG. 2 is an exploded view of the elements comprising the embodiment represented in FIG. 1.

One of the preferred embodiments for storm shutter system 10 is shown in FIGS. 1 and 2 for horizontally disposed blade assemblies 40. Other embodiments with vertically disposed blade assemblies 40 can be similarly implemented with the same inventive concept. Blade assemblies 40 include longitudinal ends 47 (and 47'), lateral ends 49 (and 49') and panel member 42 in between.

Figure 3A:
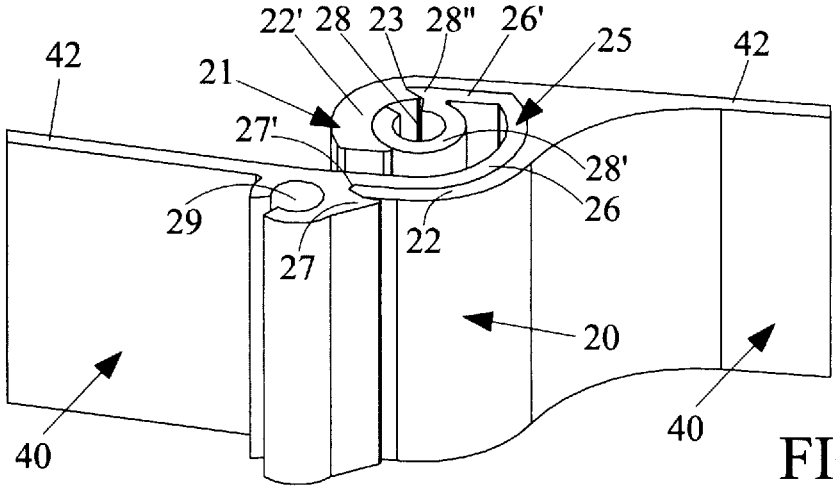
FIG. 3*a* represents an isometric view of the articulated hinge assembly in the fully extended position (180 degrees) with the storm shutter system in the closed configuration.
Figure 3B:
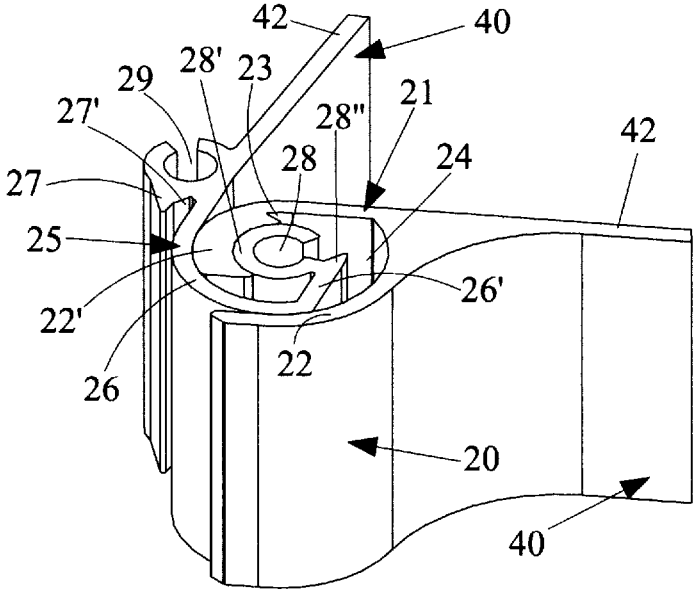
FIG. 3*b* shows an isometric view of the articulated assembly in an intermediate approximately 90 degrees position.
Figure 3C:
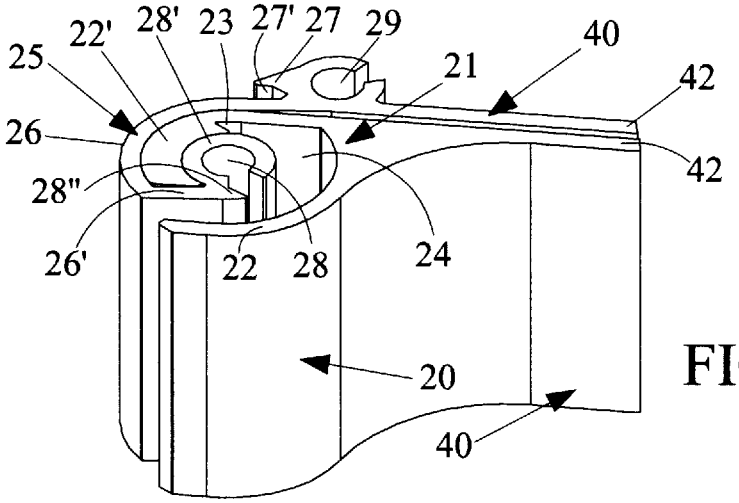
FIG. 3*c* illustrates an isometric view of the assembly in the open position used when the storm shutter system is open with the planes of contiguous articulated blade assemblies forming an angle approximately 4 degrees.
Figure 4:
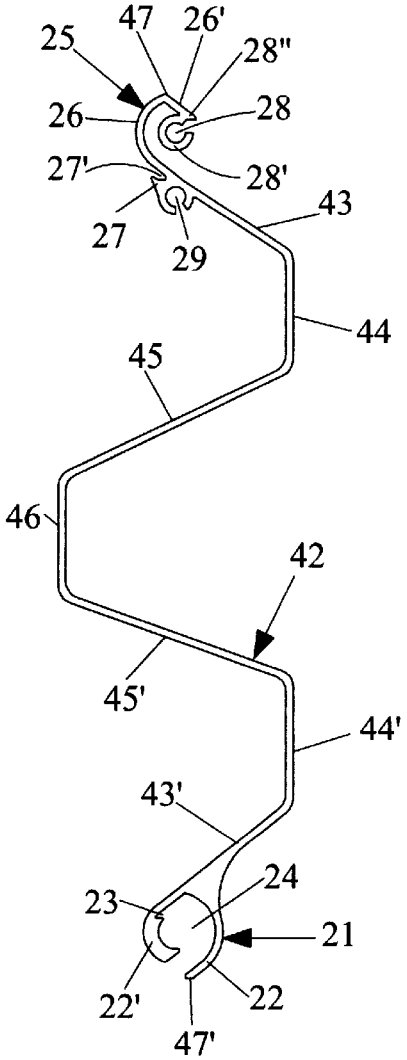
FIG. 4 is a side view of a blade assembly used in the present invention.
Figure 5:
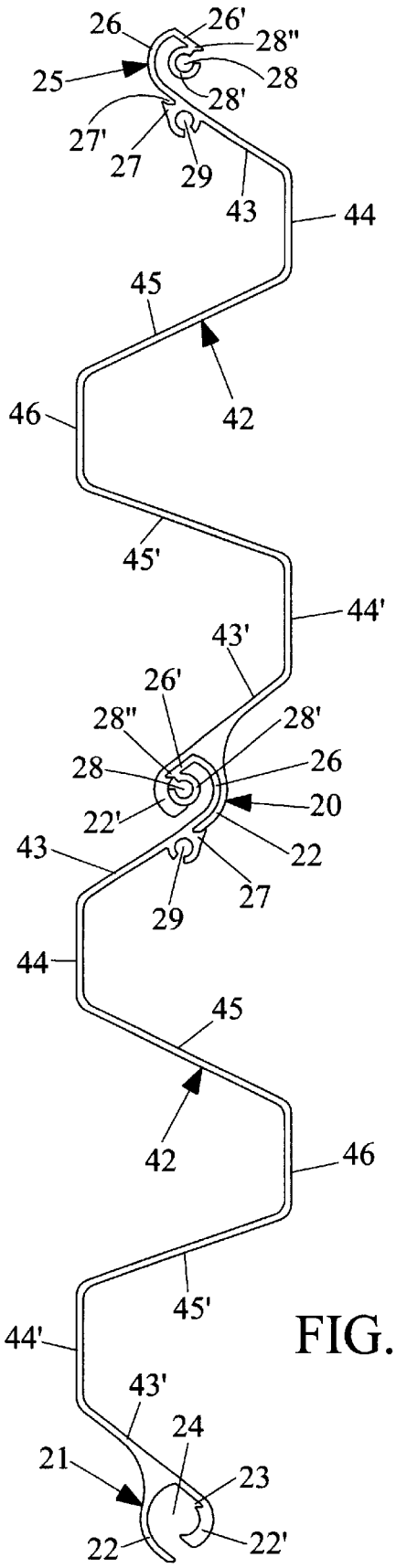
FIG. 5 is a side view of two blade assemblies represented in FIG. 4 connected together in the fully-extended (closed) position used when the storm shutter system is closed. The articulated ends being in the same plane with any wind load transmission being accomplished through compression.

Hinge assembly 20, as best seen in FIGS. 3*a*, 3*b* and 3*c*, comprises the articulated union of two contiguous cooperating blade assemblies 40. Basically, assembly 20 includes longitudinal outer socket fold 21, and longitudinal inner fold 25 formed at longitudinal ends 47 and 47' respectively. Longitudinal outer socket fold 21 and longitudinal inner fold 25 are the connecting means for blade assemblies 40. Longitudinal outer socket fold 21 is formed along one of the longitudinal ends of assembly 40. Longitudinal inner fold 25 is formed at the other longitudinal end of blade assembly 40, as best seen in FIGS. 4 and 5.

Longitudinal outer socket fold 21 includes longitudinal curved long arm 22, curved short arm 22', stopper bay 23 and internal cavity 24. Curved short arm 22' has a smaller radius of curvature than curved long arm 22, as seen in FIGS. 4 and 5. Arms 22 and 22' form a substantially cylindrical body with a longitudinal slot and defining longitudinal internal cavity 24 therein.

Longitudinal inner fold 25 includes curved portion 26, straight portion 26', and circular fold 28', defining cavity 28 therethrough. The transition between longitudinal straight portion 26' and circular fold 28' defines a longitudinal wedge 28", as best seen in FIGS. 4 and 5. Longitudinal wedge 28" is cooperatively received within stopper bay 23 when contiguous blade assemblies 40 are fully extended in the same plane. The radius of curvature of circular fold 28' is such that its outer surface is cooperatively and abuttingly received by the concave longitudinal surface of curved short arm 22'. The radius of curvature of curved portion 26 cooperatively corresponds with the internal radius of curvature of curved long arm 22. Longitudinal slotted cylinder protrusion 27 is positioned adjacent to curved portion 26 and includes stopper bay 27' that receives curved long arm 22 when two contiguous and articulated blade assemblies 40 are brought to a co-planar relationship with respect to each other. Longitudinal outer cavity 29 is defined within longitudinal slotted cylinder protrusion 27.

Pivoting pin assemblies 30 and 30', as shown en FIG. 2, include pin members 32 and 32' and roller pin members 34 and 34', respectively. Pin members 32 (and 32') and roller pin members 34 (and 34') pass through cavities 28 and longitudinal outer cavities 29, respectively. Roller pin member 34 (and 34') includes roller member 36 (and 36') rotably mounted at its distal end. Pin members 32 and roller pin members 34 are mounted to lateral ends 49 of blade assemblies 40. Pin members 32' and roller pin members 34' are mounted to the opposite lateral end 49' of blade assemblies 40.

Blade assembly 40 includes panel members 42, longitudinal outer socket fold 21 and longitudinal inner fold 25. Blade assembly 40 has locking assembly 50 mounted to lower blade 48' which corresponds to the lowermost blade assembly. In the preferred embodiment, the reinforcement folds of panel members 42 have two end diagonal portions 43 and 43', followed towards the center by two co-planar portions 44 and 44', followed by inner diagonal portions 45 and 45' which are longitudinally joined by central portion 46. Central portion 46 is in parallel relationship with respect to co-planar portions 44 and 44'.

Figure 10:
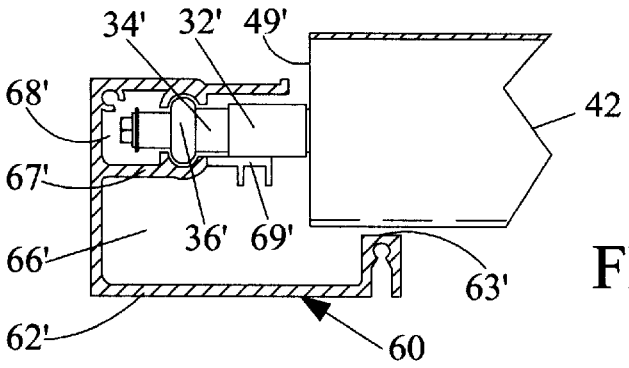
FIG. 10 shows a partial cross sectional view taken along line 10—10 in FIG. 6 showing the configuration of the elongated frame member and the disposition of the rollers.
Figure 11:
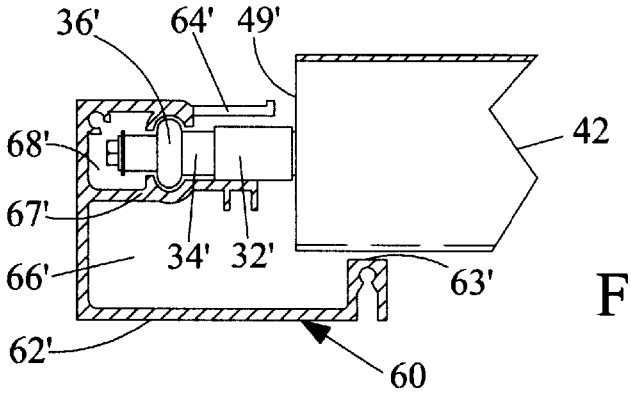
FIG. 11 shows a partial cross sectional view taken along line 11—11 in FIG. 6 showing the internal construction of the elongated frame member, the disposition of the rollers and the aperture.
Figure 12:
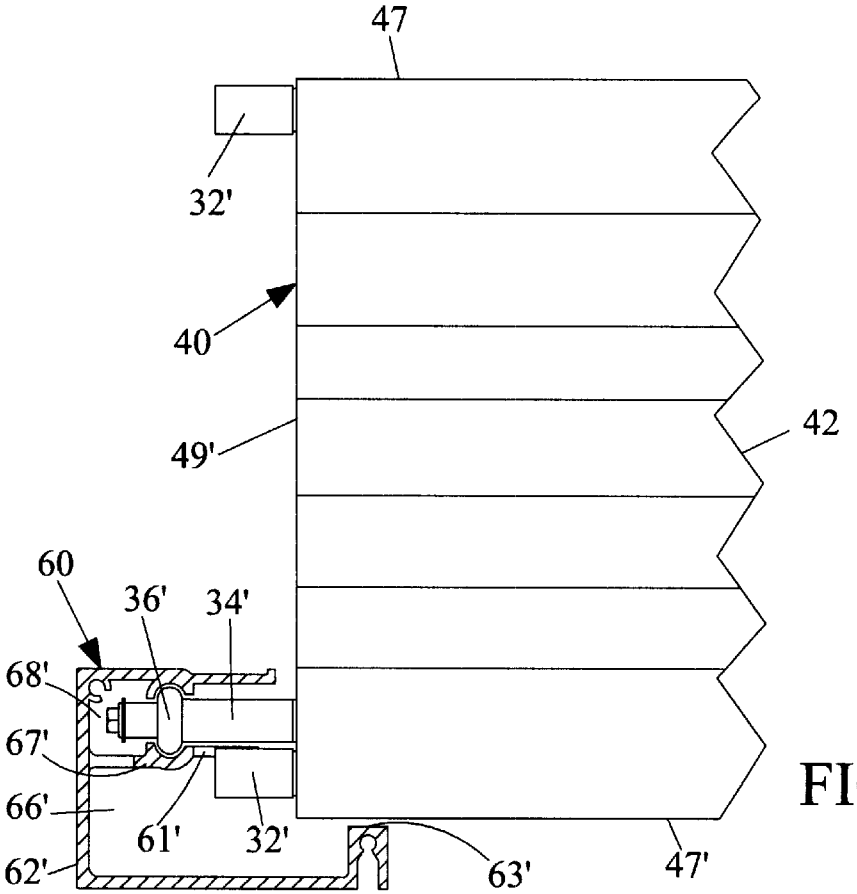
FIG. 12 shows a cross sectional view taken along line 12—12 in FIG. 8 showing the internal construction of the elongated frame member and rollers when the shutter assembly is partially open.
Figure 13:
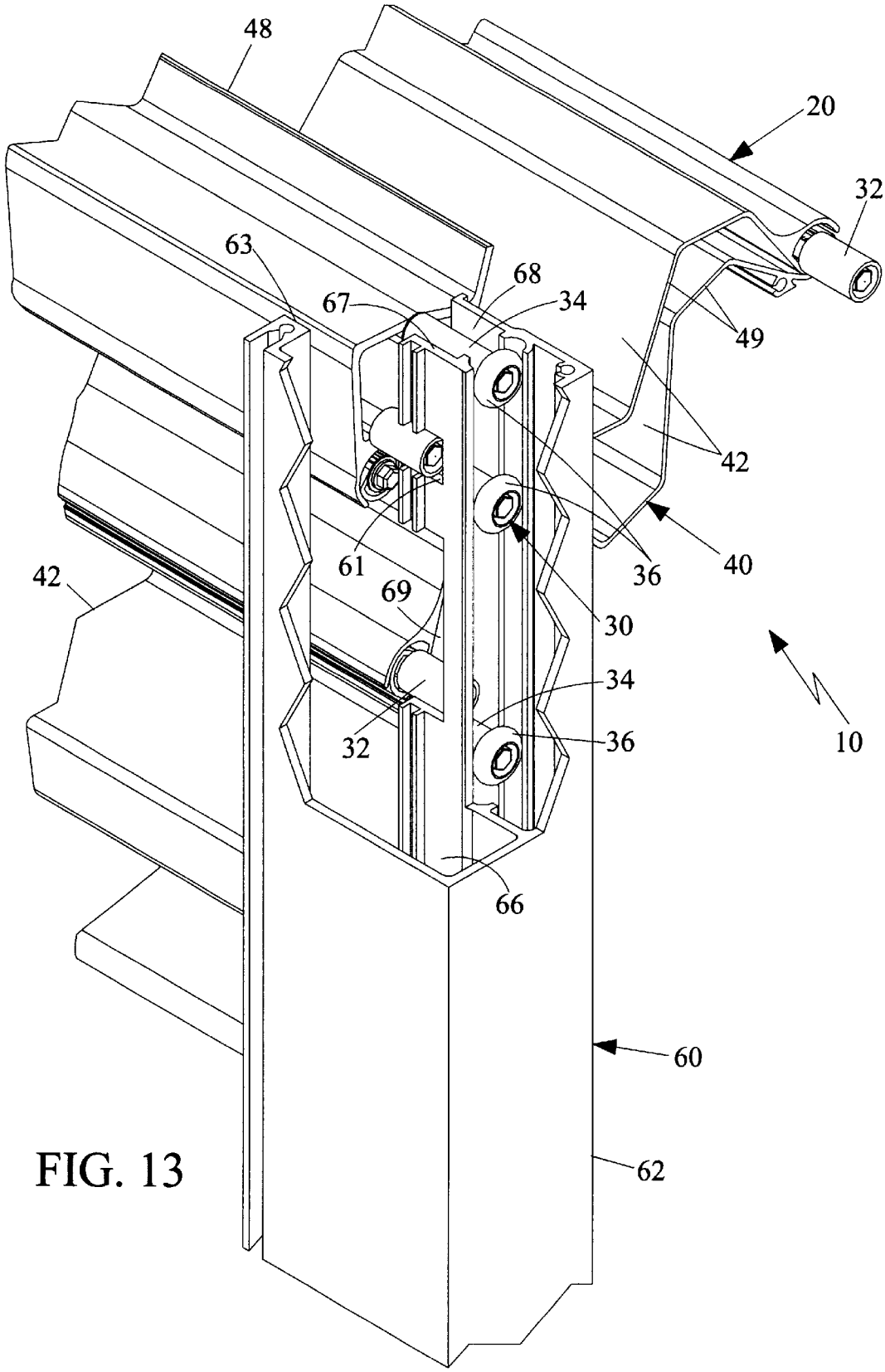
FIG. 13 shows a partial isometric view of the vertical storm shutter system represented in FIG. 1, in an intermediate position. The elongated frame member is partially cross-sectioned to show the internal disposition of the pin members and roller members inside the frame assembly.
Figure 14:
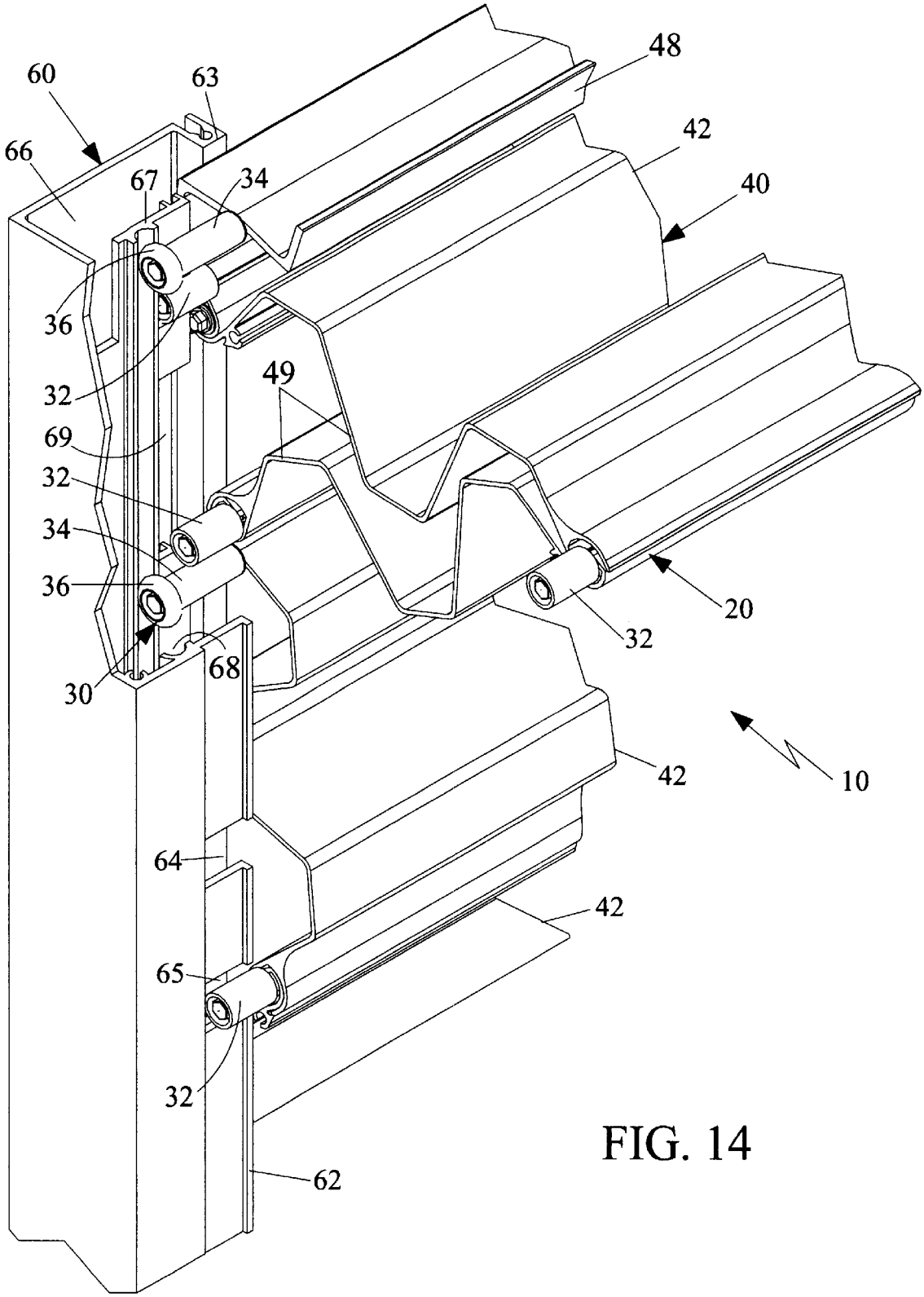
FIG. 14 shows a partial isometric view of the vertical storm shutter system represented in FIG. 13, seen from another angle (front). The elongated frame member is partially cross-sectioned to show the disposition of the pin members and roller members inside the frame assembly.

One of the longitudinal ends of panel member 42 forms longitudinal outer socket fold 21. The opposite longitudinal end of panel member 42 is longitudinal inner fold 25, as best seen in FIGS. 4 and 5. Hinge assembly 20 is formed by pivotally connecting adjacent assemblies 40. The connection results in a 180-degree capable articulation. The connection allows assemblies 40 to be positioned between two extreme positions for closing and opening storm shutter system 10, respectively, as shown in FIGS. 6 and 10.

As shown in FIG. 2, frame assembly 60 includes elongated frame members 62 and 62' that are disposed at a parallel and spaced apart relationship with respect to each other by transversal frame members 70 and 70' as seen in FIG. 1. Elongated frame member 62 (and 62') includes longitudinal stopper 63 (and 63') against which central portion 46 or co-planar portions 44 and 44' alternatively co-act with longitudinal stopper 63 and 63', as best shown in FIG. 6. Elongated frame member 62 (and 62') also includes notches 64 and 65 (and 64' and 65'), elongated wide channel 66 (and 66') and elongated small channel 68 (and 68'), as best seen in FIGS. 10; 11; 12; 13 and 14. Baffle wall 67 (and 67') separates elongated wide channel 66 (and 66') from elongated small channel 68 (and 68'). Baffle wall 67 (and 67') includes smaller cutout 61 (and 61') and larger cutout 69 (and 69'). Baffle wall 67 (and 67') limits the travel of pin members 32 (and 32) and roller pin members 34 (and 34') within small channel 68 (and 68'). Wide channel 66 (and 66') houses pulley assembly 80 (and 80').

Figure 6:
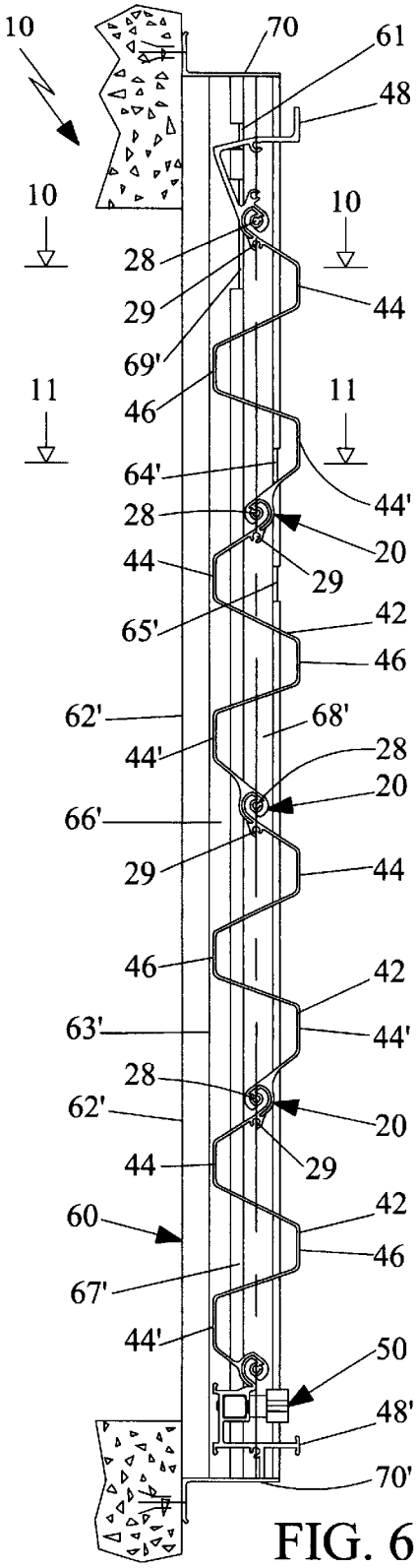
FIG. 6 is a side elevational view of the present invention, with one of the elongated frame members removed, when the shutter assembly is closed and locked.

In the position shown in FIG. 6, storm shutter assembly 10 is closed and locked. In this position, pin members 32 (and 32') and roller pin members 34 (and 34') are all aligned in channel 68 (and 68').

Figure 7:
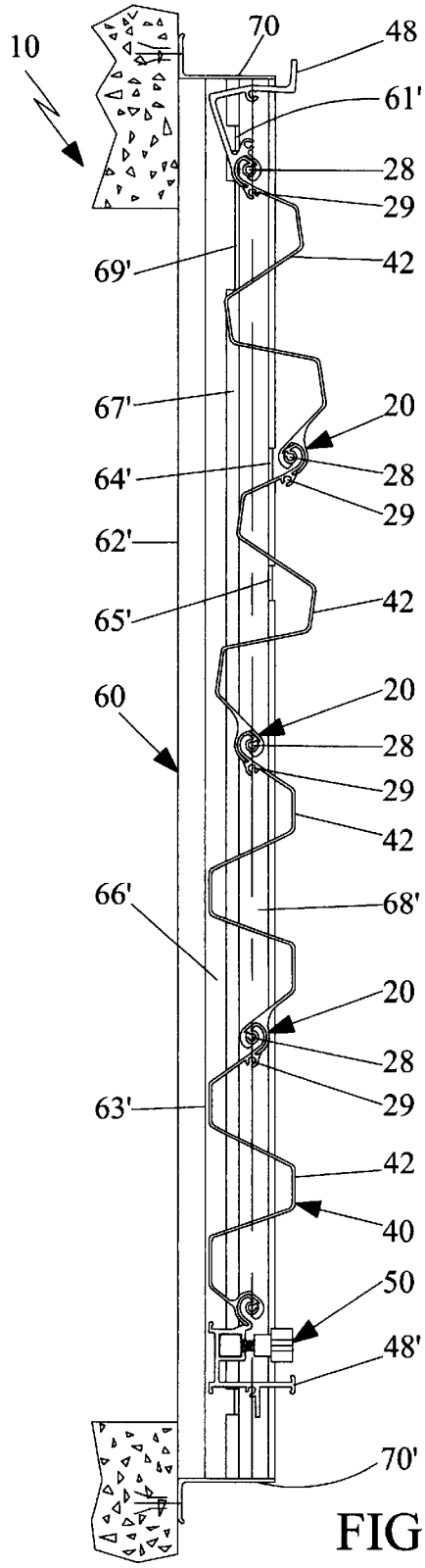
FIG. 7 is a side elevational view of the present invention, with one of the elongated frame members removed, when the shutter assembly is closed but not locked.

In the position shown in FIG. 7, storm shutter assembly 10 is closed but not locked. In this position, the user pushes up lower blade 48' forcing upper blade 48 tops against upper frame member 70. This position forces the uppermost of the pin members 32 to position itself on notch 64. Therefore, the lower end of the uppermost panel member 42 is forced to go out. Second panel member 42 includes roller pin member 34 mounted to outer cavity 29, so it is kept in channel 68.

Figure 8:
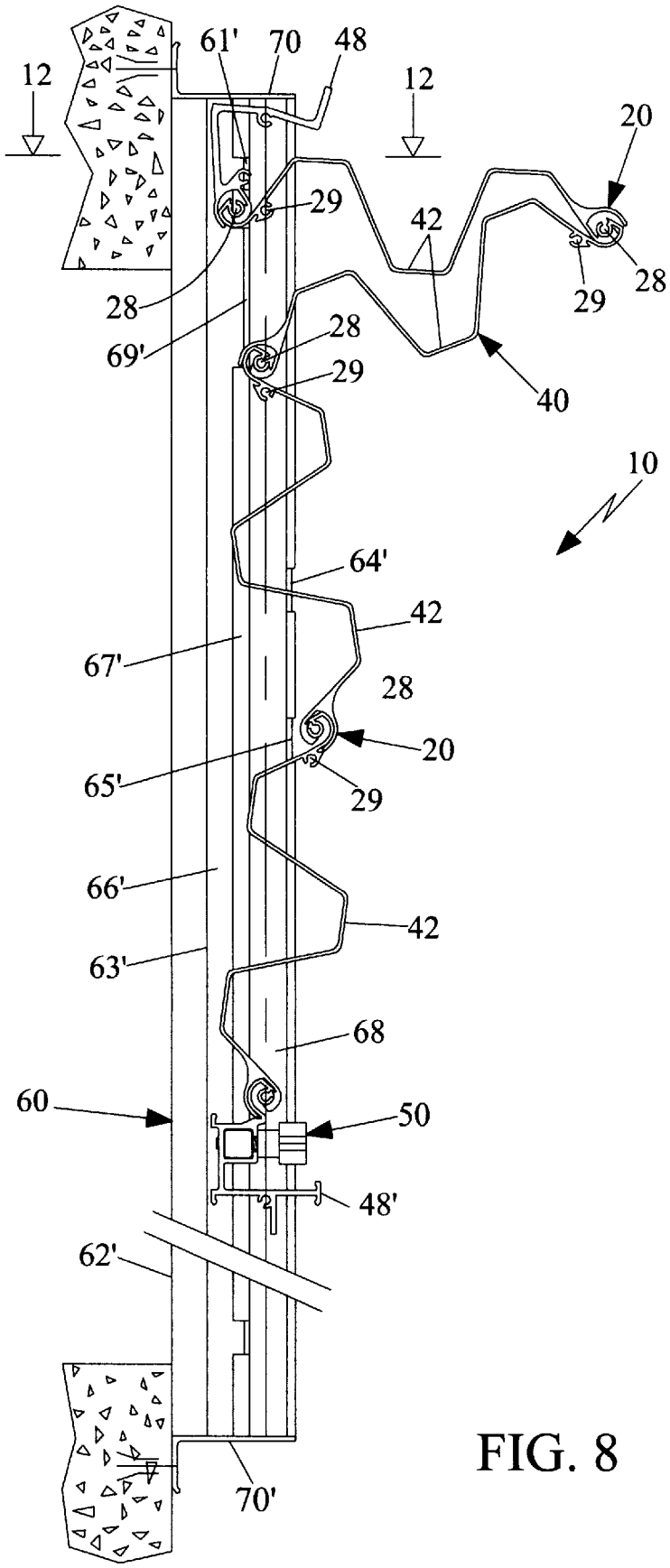
FIG. 8 is a side elevational view of the present invention, with one of the elongated frame members removed, as the shutter assembly is being opened.

In FIG. 8, storm shutter assembly 10 is shown as it continues moving up. The third panel member 42 ends with a pin member 32 mounted within central cavity 28. Then pin member 32 is forced to through-out notch 65. Therefore, the lower end of the third upper panel member 42 is forced to go out.

Figure 9:
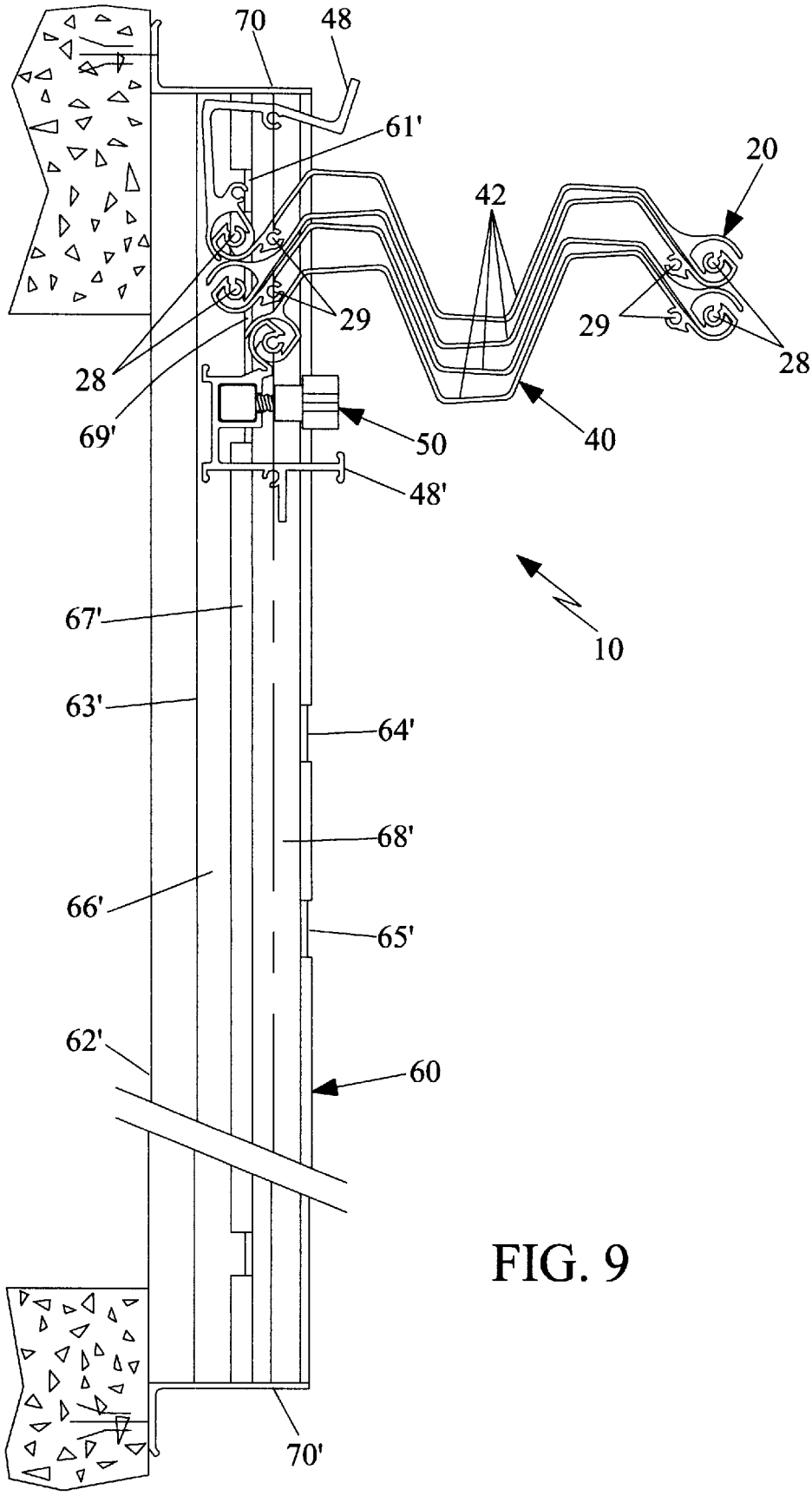
FIG. 9 is a side elevational view of the present invention, with one of the elongated frame members removed and the shutter assembly open. (opening is open)

Finally, FIG. 9 shows storm shutter assembly 10 in the open configuration. In this position, all articulated hinge assemblies 20 which have a pin member 32 mounted to central cavity 28 and no roller member 34 mounted to outer cavity 29, are positioned outside frame assembly 60. Furthermore, all articulated assemblies 20 that include roller member 34 mounted to outer cavity 29 are positioned inside elongated members 62 and 62'. Additionally, hinge assemblies 20 that are inside frame members 62 (and 62') are finally positioned as follow: roller pin members 34 (and 34') mounted to outer cavities 29 are aligned with elongated channel 68 (and 68'; pin members 32 (and 32') mounted to central cavities 28 are aligned with notch 69 (and 69').

Pulley assemblies 80 and 80' are mounted to elongated frame members 62 and 62' respectively, as shown in FIG. 2. Pulley assembly 80 (and 80') includes cable 81 (and 81'), pulley member 82 (and 82'), upper sheave 84 (and 84'), lower sheave 86 (and 86'), spring 88 (and 88') and eyebolt 89 (and 89'). Pulley assembly 80 (and 80') controls the vertical movement of blade assembly 40. Assembly 80 facilitates the upward movement of the articulated blades.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shutter assembly for building openings, comprising:

A) a frame assembly including first and second elongated structural members kept at a parallel and spaced apart relationship with respect to each other, and each including a coextensive supporting surface;

B) a plurality of articulated longitudinal blade assemblies each including a panel member with first and second longitudinal ends and first and second lateral ends, each of said first longitudinal ends including a longitudinal outer socket fold with first and second arched arms, and each of said second longitudinal ends including a longitudinal inner fold journaled within said first and second arms of a longitudinal outer socket fold of a contiguous blade assembly, and said longitudinal inner fold including a longitudinal external stopper protrusion having a first longitudinal bay for receiving said first arched arm when contiguous articulated blade assemblies are brought to the same plane, and said panel member including at least one longitudinal reinforcement fold that coacts with said supporting surface at said lateral ends so that any load applied to said blade assemblies is transmitted through said reinforcement folds to said coextensive supporting surfaces of said frame assembly; and C) means for guiding said articulated blade assemblies within said frame assembly so that said articulated blade assemblies can be selectively moved between two extreme positions to open and close said building openings.

2. The shutter assembly set forth in claim 1 wherein said longitudinal inner fold includes longitudinal curved, straight and a circular portions adjacent to each other and the outer radius of curvature of said curved and circular portions cooperatively corresponding to the internal radius of curvature of said first and second arms.

3. The shutter assembly set forth in claim 2 wherein said longitudinal inner fold includes a second longitudinal bay and said longitudinal inner fold includes a longitudinal wedge member at the transition between said circular and straight portions, said second longitudinal bay cooperatively receiving said longitudinal wedge when said contiguous blade assemblies are substantially parallel with respect to each other thereby preventing any movement along the plane of contiguous blade assemblies in the closed or extended position.

4. The shutter assembly set forth in claim 3 wherein said means for guiding said articulated blade assemblies include a plurality of roller means mounted to said first and second lateral ends and said first and second elongated structural members include longitudinal channels for cooperatively receiving said roller means.

* * * * *